US005953817A

United States Patent [19]

Watanabe et al.

[11] Patent Number: 5,953,817

[45] Date of Patent: Sep. 21, 1999

[54] PROCESS FOR PRODUCING MONOLITHIC CATALYST CONVERTER

[75] Inventors: Motoki Watanabe; Satoru Takahashi, both of Toyota; Iwao Nihashi, Okazaki; Takayuki Furuhata, Seto; Yoshiaki Kadoma, Okazaki, all of Japan

[73] Assignee: Toyota Jidosha Kabushiki Kaisha, Aichi-ken, Japan

[21] Appl. No.: 08/991,337

[22] Filed: Dec. 16, 1997

Related U.S. Application Data

[62] Division of application No. 08/726,825, Oct. 8, 1996, abandoned.

[30] Foreign Application Priority Data

Oct. 12, 1995 [JP] Japan ..... 7-264383

[51] Int. Cl.[6] ..... B23P 15/00

[52] U.S. Cl. ..... 29/890

[58] Field of Search ..... 29/890, 510, 511, 29/505, 515; 422/171, 180

[56] References Cited

U.S. PATENT DOCUMENTS

| | | | |
|---|---|---|---|
| 4,020,539 | 5/1977 | Vroman | 29/890 |
| 4,070,158 | 1/1978 | Siebels | 29/890 |
| 4,335,078 | 6/1982 | Ushijima et al. | 29/890 |
| 4,343,074 | 8/1982 | Bailey et al. | 29/890 |
| 4,864,095 | 9/1989 | Yamashita et al. . | |
| 5,008,086 | 4/1991 | Merry . | |
| 5,055,274 | 10/1991 | Abbott . | |
| 5,104,627 | 4/1992 | Usui et al. | 29/890 |
| 5,119,551 | 6/1992 | Abbott . | |
| 5,216,809 | 6/1993 | Abbott et al. . | |
| 5,220,789 | 6/1993 | Riley et al. . | |
| 5,449,500 | 9/1995 | Zettel . | |

FOREIGN PATENT DOCUMENTS

| | | |
|---|---|---|
| A-0425983 | 5/1991 | European Pat. Off. . |
| A-2-264110 | 10/1990 | Japan . |

*Primary Examiner*—I Cuda
*Attorney, Agent, or Firm*—Oliff & Berridge, PLC

[57] ABSTRACT

A process for manufacturing a monolithic catalyst converter includes the steps of fitting a monolithic catalyst into a tube-shaped workpiece having opposite opening ends through one of the opposite opening ends, and drawing the tube-shaped workpiece at the opposite opening ends into a funnel shape by means of spinning. Thus, a monolithic catalyst converter is completed without carrying out welding. Hence, the monolithic catalyst converter can be manufactured with a high material yield (or a low scrap rate), at a reduced cost and under a good working environment, because it can be manufactured without the conventional troublesome welding operation and/or a leak-test inspection.

15 Claims, 6 Drawing Sheets

PROCESS FOR PRODUCING MONOLITHIC CATALYST CONVERTER

This is a Division of application Ser. No. 08/726,825 filed Oct. 8, 1996, abandoned. The entire disclosure of the prior application(s) is hereby incorporated by reference herein in its entirety.

BACKGROUND OF THE INVENTION

1. Field of the Invention

The present invention relates to a monolithic catalyst converter, and a process for producing the same.

2. Description of the Related Art

A monolithic catalyst converter includes a catalyst container connected with the pipes of an exhaust system, and a monolithic catalyst held in the container. By using the monolithic catalyst converter, exhaust gases emitted from engines can be brought into contact with the monolithic catalyst by way of an inlet pipe of the exhaust system, and thereby the monolithic catalyst can purify the harmful components involved in the exhaust gases.

There is a clamshell (or pancake) monolithic catalyst converter. The clamshell monolithic catalyst converter is manufactured in the following manner: an upper member and a lower member are formed by pressing. Both of the upper and lower members are formed like a bowl, and have a flange which is formed all around the periphery to constitute a mating surface. Then, a monolithic catalyst is held in the upper and lower members. Finally, the upper and lower members holding the monolithic catalyst therein are welded at the flanges. In the resulting clamshell monolithic catalyst converter: the upper and lower members constitute a catalyst container including a tube-shaped member, and a pair of funnel-shaped cone members; the tube-shaped member holds the monolithic catalyst support therein; and the funnel-shaped cone members have a diametrically-reduced opening which is connected with a pipe of an exhaust system.

In the clamshell monolithic catalyst converter having the catalyst container, however, the catalyst container made of the upper and lower members is likely to be distorted by thermal influences during welding, and might accordingly be damaged in terms of assembly operability with respect to the exhaust pipes of the exhaust system.

Further, in the clamshell monolithic catalyst converter, welded portions remain in the tube-shaped member of the catalyst container as bonded portions which face each other in an axial direction thereof, and they also remain in the funnel-shaped cone members as bonded portions which face each other in a radial direction thereof. The welded portions result from the welding of the upper and lower member at their flanges. Therefore, in order to securely inhibit the exhaust gases from leaking through all of the bonded portions, the clamshell monolithic catalyst converter should be inspected by a troublesome leak test whether all of the bonded portions are formed in an air-proof manner.

Furthermore, in the clamshell monolithic catalyst converter, the flow of exhaust gases is likely to be disturbed by the bonded portions in the catalyst container. The disturbed flow increases exhaust resistance, and might eventually deteriorate the output of engines. In particular, it is believed that the deterioration of engine output results mainly from the bonded portions which extend radially in the funnel-shaped cone members. On the other hand, when a tube-shaped member and a pair of cone-shaped members are prepared independently at first, and when these 3 members are welded together in a circumferential direction so as to form a catalyst container, the welded portions result in the bonded portions which extend in a circumferential direction in the tube-shaped member and the cone-shaped members. It is also believed that these circumferentially-extending bonded portions cause problems similar to those caused by the axially-extending bonded portions.

Furthermore, in the clamshell monolithic catalyst converter, the upper and lower members should be provided with a flange which is formed all around the periphery to constitute a mating surface, and should be welded together at the flanges over a long distance by expensive welding facilities. Hence, when manufacturing the clamshell monolithic catalyst converter, the material cost and the welding cost are so high that they push up the overall manufacturing cost. In addition, there is some fear that the welding might deteriorate the working environment.

Whereas, Japanese Unexamined Patent Publication (KOKAI) No. 2-264,110 proposes a monolithic catalyst converter whose catalyst container is one-piece. According to the publication, a one-piece catalyst container is manufactured in the following manner: a tube-shaped workpiece is pressed at the opposite ends to form an inlet port and upper and lower closure ends which extend outwardly from the inlet port to the opposite sides, and an outlet port and upper and lower closure ends which extend outwardly from the outlet port to the opposite sides. Thereafter, at the opposite ends of the pressed tube-shaped workpiece, all of the upper and lower closure ends are welded together to complete a one-piece catalyst container. In the resultant monolithic catalyst converter, the catalyst container is formed integrally out of a tube-shaped workpiece. Therefore, in manufacturing the monolithic catalyst converter, the welding can be carried out over a reduced length at the opposite upper and lower closure ends. Thus, it is somehow possible to reduce the manufacturing cost, and to achieve a good working environment.

However, in the monolithic catalyst converter disclosed in the publication, the welded portions, resulting from welding the opposite upper and lower closure ends, remain as bonded portions which extend in a radial direction. Thus, even the monolithic catalyst converter has been adversely affected by the thermal influences in the welding operations, and accordingly it little exhibits perfect assembly operability with respect the exhaust pipes of the exhaust system. Moreover, the following problems are believed to arise from the radially-extending bonded portions: namely; they make the air-proof inspection indispensable; and they deteriorate the output of engines. In addition, the radially-extending bonded portions cannot reduce the manufacturing cost and establish a good working environment completely.

SUMMARY OF THE INVENTION

The present invention has been developed in view of the aforementioned circumstances. It is therefore an object of the present invention to provide a monolithic catalyst converter which can exhibit satisfactory assembly operability with respect to the exhaust pipes of an exhaust system, which can obviate the tiresome air-proof inspection, and which can inhibit the engine-output deterioration caused by the turbulence of exhaust gases. It is another object of the present invention to provide a process for manufacturing such a novel monolithic catalyst converter at a reduced cost and under a good working environment.

A first aspect of the present invention is a monolithic catalyst converter which comprises:

a monolithic catalyst; and a catalyst container disposed in an exhaust system, and including a tube-shaped member for holding the monolithic catalyst therein, the tube-shaped member having opposite ends, and a pair of funnel-shaped cone members to be connected with pipes of the exhaust system, the funnel-shaped cone members disposed at the opposite ends of the tube-shaped member and formed free from welding and integrally with the tube-shaped member.

In accordance with the first aspect of the present invention, in the present monolithic catalyst converter, the tube-shaped member and the funnel-shaped cone members are formed integrally and free from welding to constitute the catalyst container. Accordingly, the catalyst container is free from the bonded portions which result from the welded portions, and which extend in an axial direction, in a radial direction or in a circumferential direction.

In manufacturing the present monolithic catalyst converter, a tube-shaped workpiece can be employed. Excepting the case where a seamless tube-shaped workpiece can be employed, the tube-shaped workpiece is usually prepared by winding a plate-shaped workpiece in a tubular manner. Thus, an axially-extending bonded portion is present in the thus prepared tube-shaped workpiece originally. Hence, it is preferred to employ a seamless tube-shaped workpiece as the tube-shaped workpiece. Note that, however, even if the tube-shaped workpiece is a seamed tube-shaped workpiece which is commercially available in general, its axially-extending bonded portion does hardly impair the air-tightness of the resultant catalyst container even after it is processed completely. Hence, in the present invention, the term, "bonded portion", does not involve the bonded portions which have been existing in tube-shaped workpieces originally. In other words, the tube-shaped member and the funnel-shaped cone members can be formed free from welding and integrally out of a tube-shaped workpiece which originally involves an axially-extending welded portion therein. Thus, the catalyst container of the present monolithic catalyst converter can be prepared out of a seamless tube-shaped workpiece or a seamed tube-shaped workpiece. Therefore, in the phrase, "formed free from welding", the term, "welding", does not mean the welding operation in which a plate-shaped or sheet-shaped workpiece is welded to a tube-shaped workpiece.

Thus, the present monolithic catalyst converter is manufactured without carrying out the welding operation, which has been done conventionally, at all. Therefore, the catalyst container is little distorted by the thermal influences which result from the welding operation.

Moreover, the present monolithic catalyst converter is free from the bonded portions which have existed in the conventional clamshell monolithic catalyst converters. Consequently, without ever subjecting the present monolithic catalyst converter to the troublesome leak-test inspection which has been carried out conventionally, it is possible to reliably inhibit the exhaust gases from leaking. In addition, in the catalyst container of the present monolithic catalyst converter, there are no bonded portions which have been present in the catalyst container of the conventional clamshell monolithic catalyst converters. As a result, it is possible to smoothly flow the exhaust gases in the catalyst container.

As having described so far, the present monolithic catalyst converter according to the first aspect of the present invention effects the following advantages, because it is free from the bonded portions which have resulted from the welding operation, and which have been present conventionally: namely; it can exhibit favorable assembly operability with respect to the exhaust pipes of an exhaust system; it can obviate the tiresome air-proof inspection; and it can inhibit the engine-output deterioration which has been caused by the turbulence of the exhaust gases.

A second aspect of the present invention is a process for manufacturing a monolithic catalyst converter, and the process comprises the steps of:

fitting a monolithic catalyst into a tube-shaped workpiece having opposite opening ends through one of the opposite opening ends; and drawing the tube-shaped workpiece at the opposite opening ends into a funnel shape, thereby completing a monolithic catalyst converter without carrying out welding.

In the second aspect of the present invention, the present process for manufacturing a monolithic catalyst converter can be selectively carried out in the following two distinct manners:

before the monolithic-catalyst-fitting step, the tube-shaped workpiece can be drawn into a funnel shape at one of the opposite opening ends. Then, the monolithic-catalyst-fitting step can be carried out. Finally, the tube-shaped-workpiece-drawing step can be carried out, thereby drawing the tube-shaped workpiece into a funnel shape at another one of the opposite opening ends; and the monolithic-catalyst-fitting step can be carried out prior to the tube-shaped workpiece-drawing step as described above. Then, the tube-shaped workpiece with the monolithic catalyst disposed therein can be drawn into a funnel shape at both of the opposite opening ends.

In accordance with the second aspect of the present invention, it is possible to manufacture the present monolithic catalyst converter recited in the first aspect of the present invention. In the resulting present monolithic catalyst converter, the catalyst container is formed integrally out of the tube-shaped workpiece, and free from welding. Accordingly, in manufacturing the present monolithic catalyst, it is possible to reduce the material cost, and to obviate the conventional welding operation.

As having described so far, the present monolithic-catalyst-converter-manufacturing process according to the second aspect of the present invention effects the following advantages: it can reduce the material cost; and it can obviate the conventional welding operation. Consequently, the present monolithic-catalyst-converter-manufacturing process can complete the monolithic catalyst converter according to the first aspect of the present invention at a reduced manufacturing cost under a good environment.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure.

DETAILED DESCRIPTION OF THE PREFERRED EMBODIMENTS

Having generally described the present invention, a further understanding can be obtained by reference to the specific preferred embodiments which are provided herein for the purpose of illustration only and not intended to limit the scope of the appended claims.

First Preferred Embodiment

Figure 1:
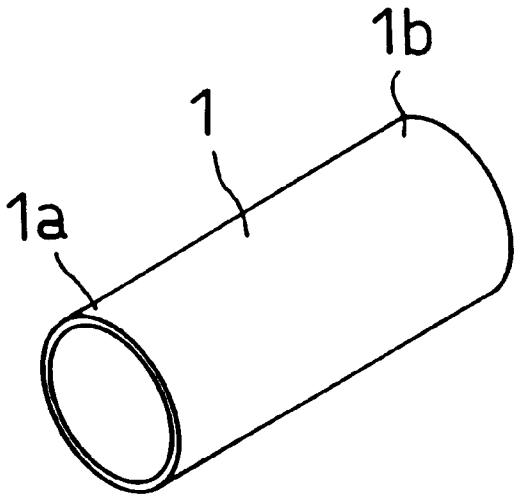
FIGS. 1(A)–1(C) are a perspective view for illustrating a monolithic-catalyst-converter-manufacturing process of a First Preferred Embodiment according to the present invention.
Figure 1:
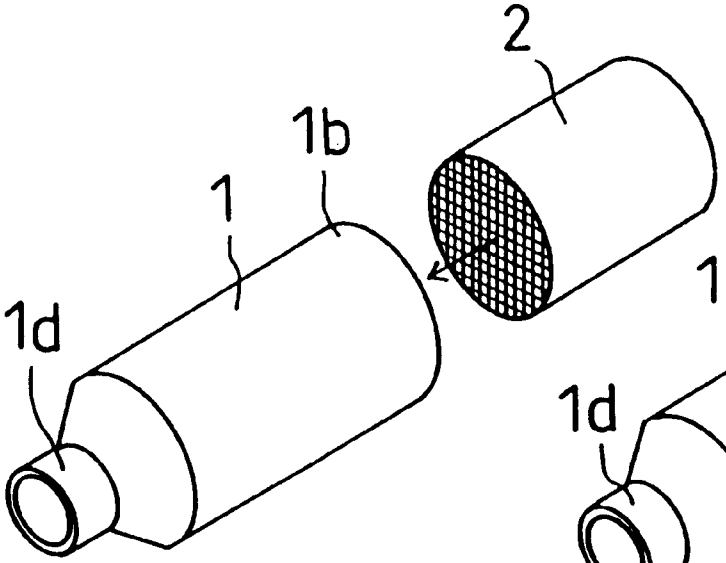
Figure 1:
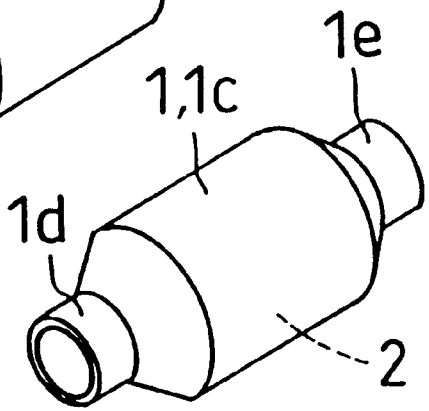

As illustrated in FIGS. 1(A) and 1(B), a tube-shaped workpiece 1, and a monolithic catalyst 2 are prepared. The tube-shaped workpiece 1 was made from a stainless steel, and prepared by winding a plate-shaped workpiece in a tubular manner. Thus, an axially-extending welded portion remains in the tube-shaped workpiece 1 originally. The monolithic catalyst 2 includes a ceramics support employed as a support substrate, a catalyst carrier layer formed of ceramics and disposed on the ceramics support, and a catalyst ingredient, such as platinum, or the like, loaded on the catalyst carrier layer. Note that, instead of the ceramics support, it is possible to employ a metallic support as a support substrate for the monolithic catalyst 2. The metallic support herein includes a honeycomb substance which is formed by winding a corrugated plate and a flat plate, and an outer tube for holding the honeycomb substance therein.

Drawing Step

Figure 6:
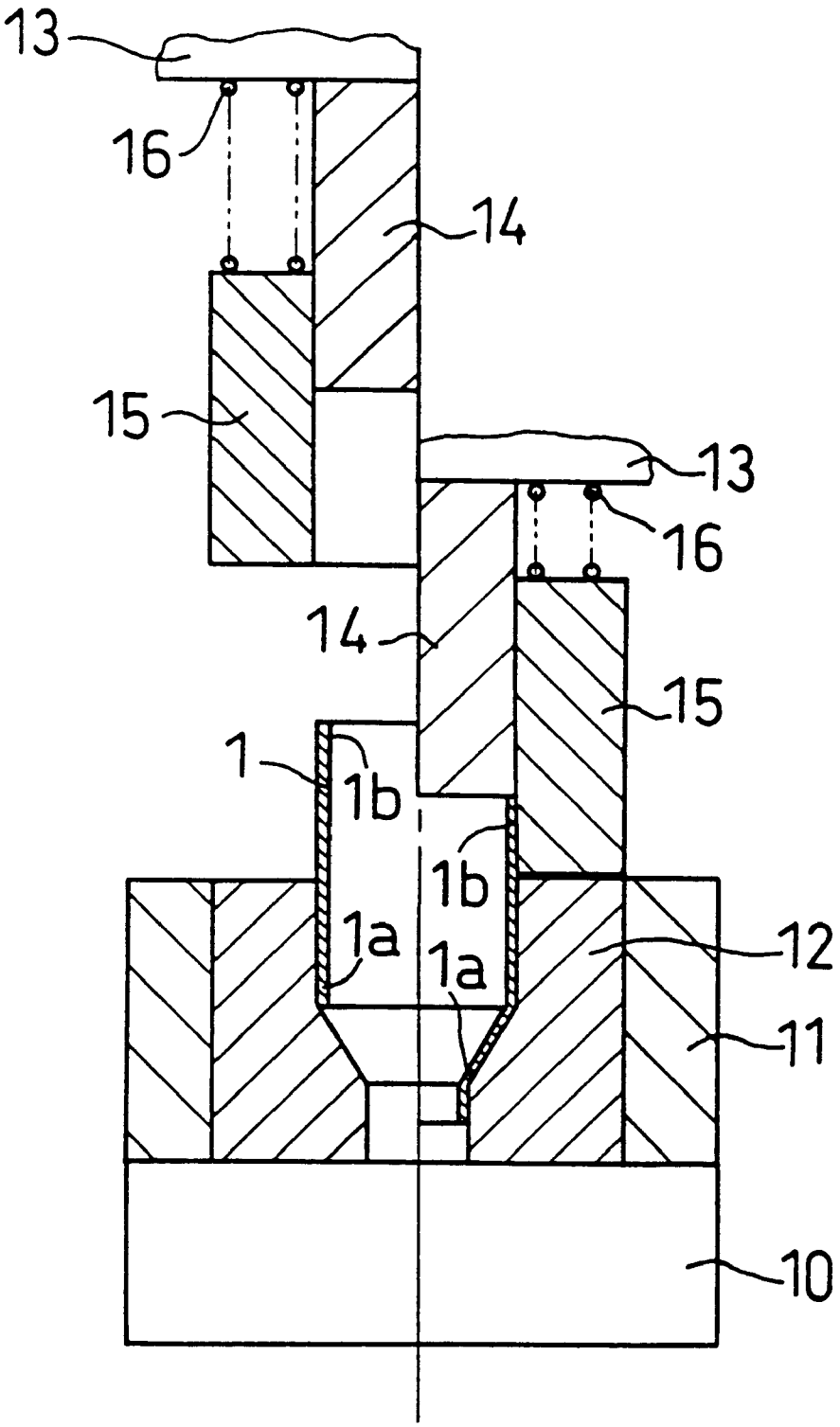
FIG. 6 is a cross-sectional view for illustrating a drawing apparatus, including dies, which is employed in the First and Second Preferred Embodiments.
Figure 7:
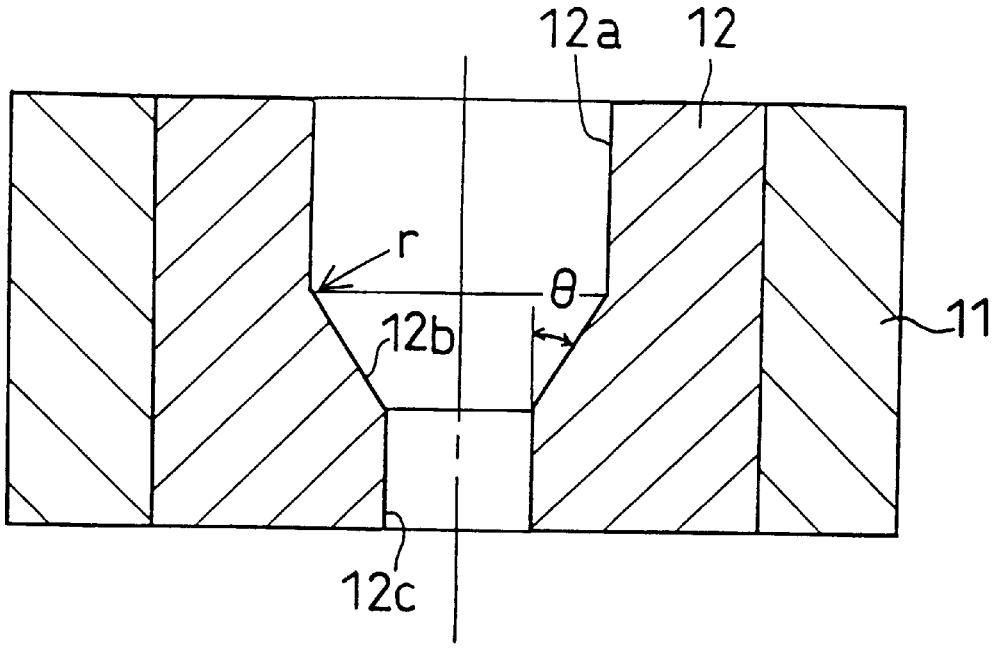
FIG. 7 is a partly-enlarged cross-sectional view for illustrating the drawing apparatus which is employed in the First and Second Preferred Embodiments.

Then, as illustrated in FIG. 1(B), the tube-shaped workpiece 1 is drawn into a funnel shape at an opposite opening end 1*a*. In the drawing operation, a drawing apparatus shown in FIG. 6 is employed, and includes dies. As illustrated in FIG. 6, in the drawing apparatus, a die holder 11 is fixed on the upper surface of a stationary table 10, and a lower die 12 (illustrated in FIG. 7 in detail) is further fixed in the die holder 11. The die holder 11 is made from a steel. As illustrated in FIG. 7, the lower die 12 includes a first cylinder-shaped inner peripheral surface 12*a*, a tapered surface 12*b*, and a second cylinder-shaped inner peripheral surface 12*c*, which are drilled through from the top surface to the bottom surface in this order. The first cylinder-shaped inner peripheral surface 12*a* has an inside diameter which is substantially identical with an outside diameter of the tube-shaped workpiece 1. The tapered surface 12*b* continues from the first cylinder-shaped inner peripheral surface 12*a* by way of a rounded corner having a radius of curvature "r", and inclines by θ (deg.) with respect to a vertical line. The second cylinder-shaped inner peripheral surface 12*c* continues from the tapered surface 12*b*, and has an inside diameter smaller than that of the first cylinder-shaped inner peripheral surface 12*b*. Turning back to FIG. 6, a movable table 13 is disposed so as to move vertically above the stationary table 10. A punch 14 is disposed on the bottom surface of the movable table 13, and has an outside diameter which is substantially identical with the inside diameter of the first cylinder-shaped inner peripheral surface 12*a* of the lower die 12. Moreover, a ring-shaped upper die 15 is disposed on the movable table 13 by way of a pressure spring 16 so as to move vertically around the punch 14, and has an inside diameter which is substantially identical with the inside diameter of the first cylinder-shaped inner peripheral surface 12*a* of the lower die 12.

In drawing the opposite end 1*a* of the tube-shaped workpiece 1 into a funnel shape as illustrated FIG. 1(B) by using the thus constructed drawing apparatus, the movable table 12 is first placed at the top dead center as illustrated in the left-hand-side half of FIG. 6, and the opposite end 1*a* of the tube-shaped workpiece 1 is fitted into the first cylinder-shaped inner peripheral surface 12*a* of the lower die 12. Then, as illustrated in the right-hand-side half of FIG. 6, the movable table 12 is descended to the bottom dead center. At this moment, the bottom surface of the upper die 15 is brought into contact with the top surface of the lower die 12, and the pressure spring 16 is contracted. Moreover, the bottom surface of the punch 14 is brought into contact with another opposite opening end 1*b* of the tube-shaped workpiece 1. The descending movable table 13 presses the opposite opening end 1*a* of the tube-shaped workpiece 1 deep into the second cylinder-shaped inner peripheral surface 12*c* via the rounded corner having a radius of curvature "r" and the tapered surface 12*b*. Thus, the opposite opening end 1*a* of the tube-shaped workpiece 1 is drawn completely, and is turned into a funnel-shaped cone member 1*d*.

Figure 8:
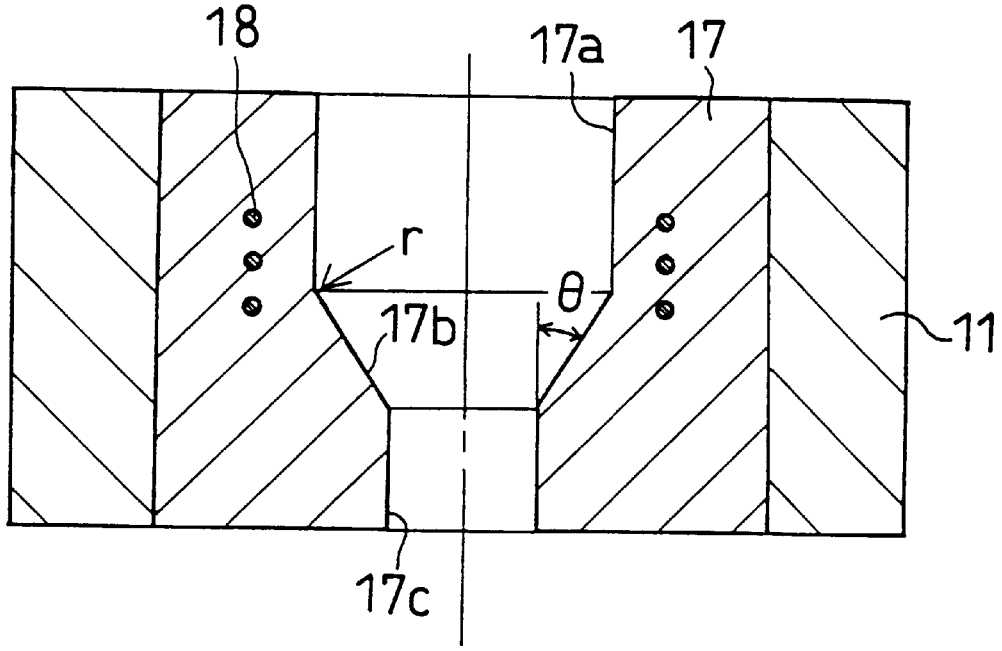
FIG. 8 is a partly-enlarged cross-sectional view for illustrating an alternative drawing apparatus, including dies, which can be employed in the First and Second Preferred Embodiments.

Note that, instead of the lower die 12, it is possible to employ a lower die 17 illustrated in FIG. 8. The lower die 17 includes a first cylinder-shaped inner peripheral surface 17*a*, a tapered surface 17*b*, and a second cylinder-shaped inner peripheral surface 17*c*, which are drilled through from the top surface to the bottom surface in this order in a manner similar to the lower die 12, and further includes a coil 18 for high-frequency heating. The high-frequency-heating coil 18 is built in the lower die 17, and is disposed externally around the first cylinder-shaped inner peripheral surface 17*a* and the tapered surface 17*b*. When employing the lower die 17, the opposite opening end 1*a* of the tube-shaped workpiece 1 can be heated by means of induction heating effected by the high-frequency-heating coil 18, and can be simultaneously subjected to the drawing. As a result, the lower die 17 can process the opposite opening end 1*a* of the tube-shaped workpiece 1 with good forming ability. In addition, instead of heating the opposite opening end 1*a* of the tube-shaped workpiece 1 locally, it is possible to locally anneal the opposite opening end 1*a* in order to process the opposite opening end 1*a* with good forming ability.

Figure 9:
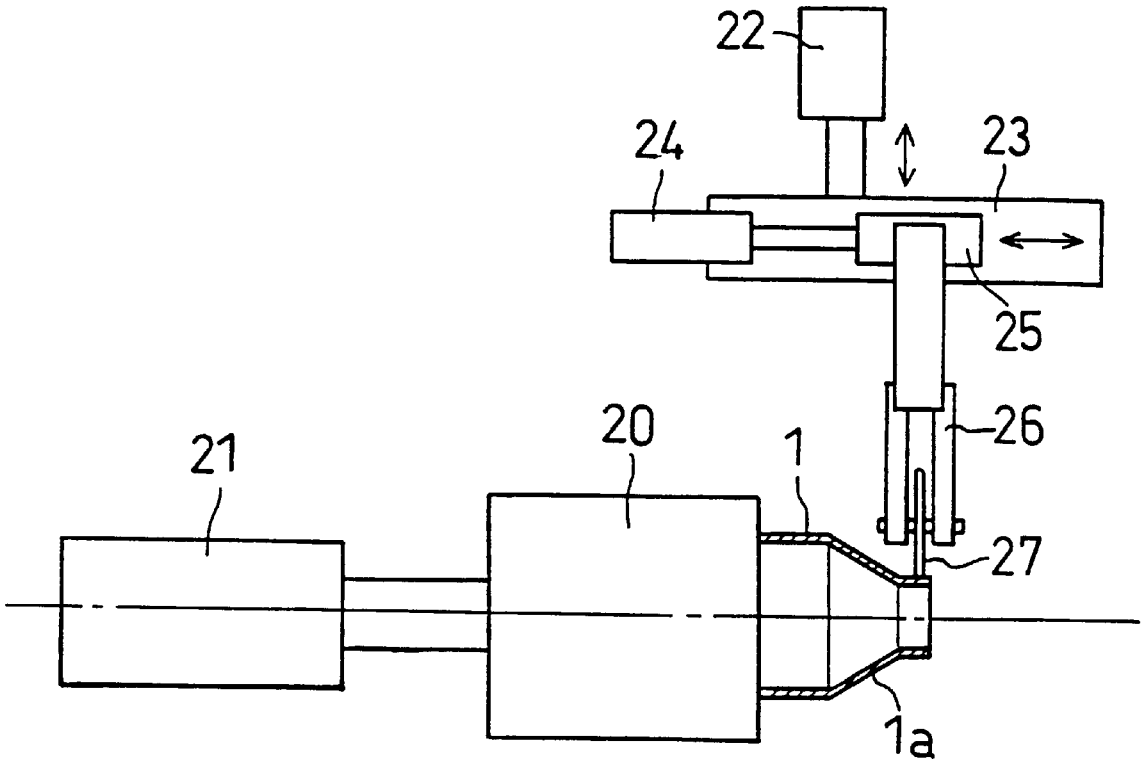
FIG. 9 is a cross-sectional view for illustrating a spinning drawing apparatus which can be employed alternatively in the First and Second Preferred Embodiments.

Moreover, instead of the drawing apparatus with dies illustrated in FIG. 6, it is possible to employ a spinning drawing apparatus illustrated in FIG. 9 to carry out the present invention. For instance, in the spinning drawing apparatus, a chuck 20 can hold a tube-shaped workpiece 1 so that an opposite opening end 1*a* of the tube-shaped workpiece 1 extends horizontally. The chuck 20 is fastened to a rotary shaft of a motor 21. Thus, the tube-shaped workpiece 1 is disposed rotatably about its axial center line. Above the opposite opening end 1*a* of the tube-shaped workpiece 1, there is disposed a vertically movable table 23 which can be moved vertically by a hydraulic cylinder 22. Further, the vertically movable table 23 is provided with a horizontally movable table 25 which can be moved horizontally by a hydraulic cylinder 24. Furthermore, the horizontally movable table 25 is provided with a roller 27 by way of a bracket 26. The roller 27 has an axial center line which is parallel to that of the tube-shaped workpiece 1, and accordingly can be driven as the tube-shaped workpiece 1 rotates.

Then, as illustrated in FIG. 1(B), the tube-shaped workpiece 1 is drawn into a funnel shape at the opposite opening end 1*a*. In this alternative drawing operation, as can be seen from FIG. 9, the tube-shaped workpiece 1 is rotated about the axial center line by the motor 21, and simultaneously the roller 27 is pressed gradually but heavily onto the opposite opening end 1*a* of the tube-shaped workpiece 1 by controlling the operations of the hydraulic cylinders 22 and 24. The alternative drawing operation is thus completed at the opposite end opening 1*a* of the tube-shaped workpiece 1. Note that, in the alternative drawing operation as well, it is possible to locally heat or anneal the opposite end opening 1*a* in order to improve the forming ability.

Monolithic-Catalyst-Fitting Step

Thereafter, as illustrated in FIG. 1(B), a monolithic catalyst 2 is fitted into the inside of the tube-shaped workpiece 1 through another opposite end opening 1*b*.

Drawing Step

Finally, as illustrated in FIG. 1(C), the opposite end opening 1*b* of the tube-shaped workpiece 1 is drawn by using the drawing apparatus with dies, or by using the spinning drawing apparatus. Thus, in the same manner as the drawing step described above, the opposite end opening 1*b* is drawn into a funnel-shaped cone member 1*e*. Note that the tube-shaped member 1*c* is constituted by the portion of the tube-shaped workpiece 1 excepting the cone members 1*d* and 1*e*.

Figure 3:
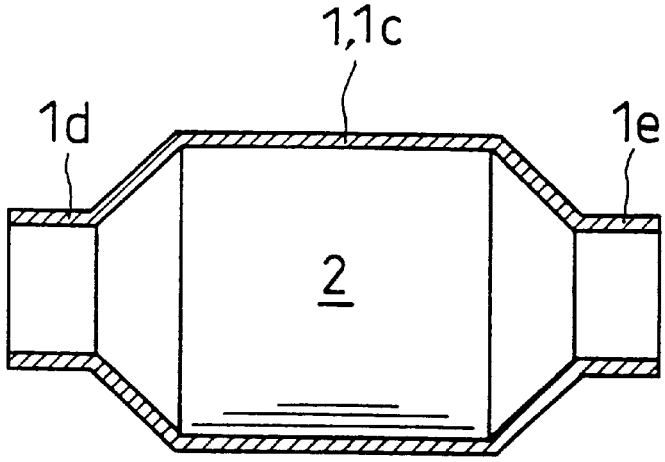
FIG. 3 is a cross-sectional view for illustrating a monolithic catalyst converter which is manufactured by the First and Second Preferred Embodiments.

A monolithic catalyst converter is thus manufactured as illustrated FIG. 3. In this monolithic catalyst converter, the tube-shaped member 1*c*, and the opposite cone members 1*d* and 1*e* are formed integrally out of the tube-shaped workpiece 1 so as to constitute the catalyst container 1. The monolithic catalyst 2 is held in the tube-shaped member 1*c*. The opposite cone members 1*d* and 1*e* are connected with the pipes of an exhaust system at their diametrically-reduced openings.

The monolithic catalyst converter produces the following advantages, because it is not subjected to the welding operation which has been carried out conventionally: namely; its catalyst container 1 is little distorted by the thermal influences resulting from the welding operation; and it enables to assemble the opposite cone members 1*d* and 1*e* with good operability.

Further, the monolithic catalyst converter is free from the axially-extending bonded portions, the radially extending bonded portions, and the circumferentially-extending bonded portions which result from the welded members. Therefore, it is not necessary to subject the monolithic catalyst converter to the troublesome leak-test inspection which has been carried out conventionally. Indeed, the monolithic catalyst converter can securely inhibit the exhaust gases from leaking, and can be manufactured with a high material yield (or a low scrap rate).

Furthermore, compared with the conventional clamshell monolithic catalyst converters which employ the upper and lower members having a flange, the material cost is reduced in manufacturing the monolithic catalyst converter, and the welding operation has been obviated therein. In fact, the monolithic catalyst converter enables to reduce the manufacturing cost, and to realize a good working environment.

Moreover, in operation, the monolithic catalyst converter takes in the exhaust gases, emitted from engines by way of the inlet pipe of the exhaust system, to introduce them to the monolithic catalyst 2, and the monolithic catalyst 2 purifies the harmful components involved in the exhaust gases. In the purifying operation, the exhaust gases can flow smoothly in the catalyst container 1, because the monolithic catalyst converter has no bonded portions in the catalyst container 1. Such bonded portions have existed inevitably in the catalyst container of the conventional clamshell monolithic catalyst converters. As a result, the monolithic catalyst converter can inhibit the exhaust resistance from increasing, and accordingly can keep the engine output from deteriorating.

Second Preferred Embodiment

Monolithic-Catalyst-Fitting Step

Figure 2:
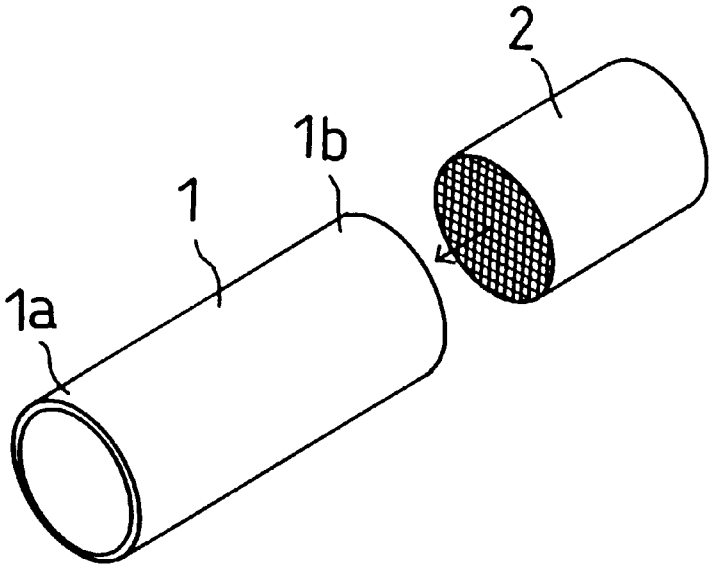
FIGS. 2(A)–2(C) are a perspective view for illustrating a monolithic-catalyst-converter-manufacturing process of a Second Preferred Embodiment according to the present invention.
Figure 2:
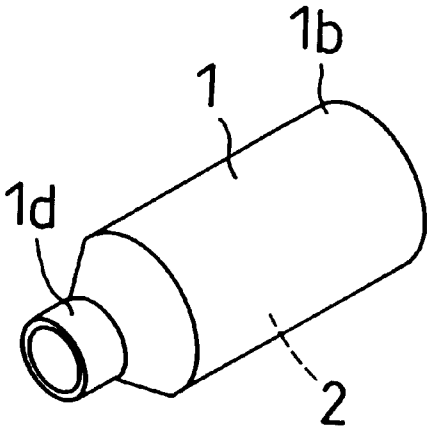
Figure 2:
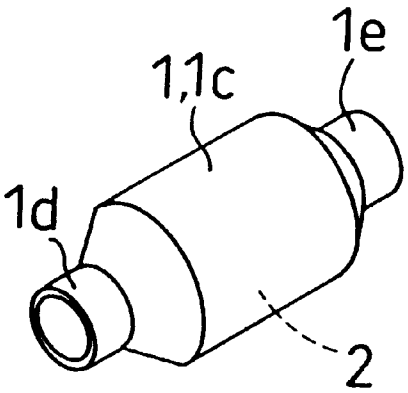

As illustrated in FIG. 2(A), in the Second Preferred Embodiment according the present invention, a monolithic catalyst 2 is first fitted into a tube-shaped workpiece 1 through either an opposite end opening 1*a* or another opposite opening end 1*b*.

Drawing Step

Then, as illustrated in FIGS. 2(B) and 2(C), the opposite end openings 1*a* and 1*b* of the tube-shaped workpiece 1 are drawn continuously by using the drawing apparatus with dies (shown in FIGS. 6 through 8), or by using the spinning drawing apparatus (shown in FIG. 9). Thus, the opposite end openings 1*a* and 1*b* are drawn into funnel-shaped cone members 1*d* and 1*e*. Except that the opposite end openings 1*a* and 1*b* are subjected to the drawing operation continuously, the drawing step of the Second Preferred Embodiment was carried out in the same manner as the First Preferred Embodiment.

In accordance with the manufacturing process of the Second Preferred Embodiment, the drawing operation can be carried out continuously. Therefore, it is possible to reduce the overall manufacturing time.

In addition to the reduction in the overall manufacturing time, it is apparent that the Second Preferred Embodiment operates similarly to produce the advantages effected by the First Preferred Embodiment. Thus, the Second Preferred Embodiment can manufacture a monolithic catalyst converter which is identical with the one illustrated in FIG. 3, and which is manufactured by the First Preferred Embodiment.

Third Preferred Embodiment

Figure 4:
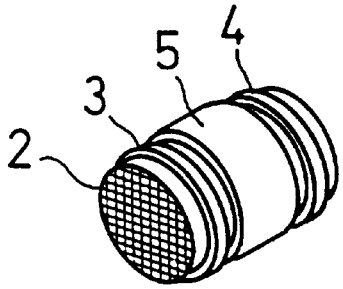
FIG. 4 is a perspective view for illustrating a monolithic catalyst, and component parts related thereto, which are employed in a Third Preferred Embodiment according to the present invention.

As illustrated in FIG. 4, in the Third Preferred Embodiment according to the present invention, a monolithic catalyst 2 is provided with ring-shaped holding members 3 and 4. The ring-shaped holding members 3 and 4 are fastened onto the peripheral surface of the opposite-end sides of the monolithic catalyst 2, and include an aggregate of stainless steel fibers which exhibit a larger thermal expansion coefficient than that of a tube-shaped workpiece 1. Moreover, the monolithic catalyst 2 is provided with a sealing member 5. The sealing member 5 is wound around the middle peripheral surface of the monolithic catalyst 2, and includes ceramics fibers and vermiculite such that the sealing member 5 expands and solidifies at elevated temperatures. The monolithic catalyst 2 with the extra component parts provided is fitted into a tube-shaped workpiece 1, instead of the monolithic catalyst 2 employed in the First and Second Preferred Embodiments. Excepting the construction of the monolithic catalyst 2, the Third Preferred Embodiment is carried out in the same manner as the First or Second Preferred Embodiment.

Figure 5:
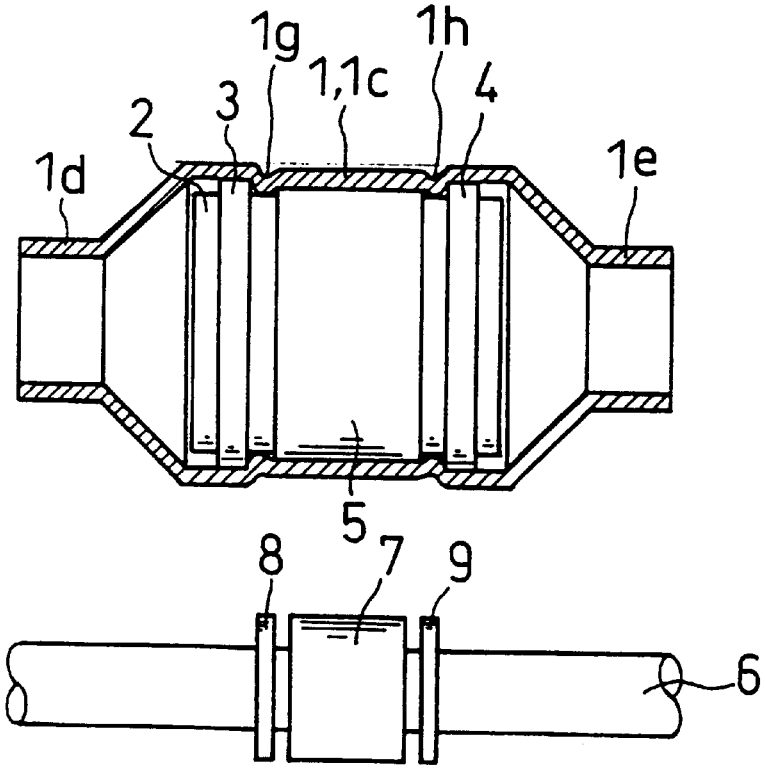
FIG. 5 is a cross-sectional view for illustrating a monolithic catalyst converter which is manufactured by the Third Preferred Embodiment, and a pressing jig which is employed therein.

In addition, in the Third Preferred Embodiment, a pressing jig is prepared as illustrated in FIG. 5. As shown in the drawing, the pressing jig includes a shaft 6, a major-width roller 7 which is disposed around the shaft 6, and a pair of minor-width rollers 8 and 9 which are disposed around the shaft 6 on both sides of the roller 7. The major-width roller 7 has a width which is slightly smaller than that of the sealing member 5. The minor-width rollers 8 and 9 has a width which is smaller than the interval between the sealing member 5 and the ring-shaped holding members 3 and 4. Thus, the pressing jig is constructed so that the minor-width roller 8 can be positioned between the holding member 3 and the sealing member 5, and so that the minor-width roller 9 can be positioned between the holding member 4 and the sealing member 5.

In the Third Preferred Embodiment, after carrying out the monolithic-catalyst-fitting step and the drawing step in the same manner as the First or Second Preferred Embodiment, the tube-shaped workpiece 1 and the pressing jig are rotated about the axial center line, and are pressed against each other. Accordingly, the roller 8 plastically deforms the tube-shaped member 1*c* between the holding member 3 and the sealing member 5, and the roller 9 plastically deforms the tube-shaped member 1*c* between the holding member 4 and the sealing member 5. Thus, a ring-shaped indentation 1*g*, and a ring-shaped indentation 1*h* are formed between the holding member 3 and the sealing member 5, and between the holding member 4 and the sealing member 5, respectively. Moreover, the roller 7 plastically deforms the tube-shaped workpiece 1 between the indentations 1*g* and 1*h*. Thus, the tube-shaped member 1*c* is reduced diametrically between the indentations 1*g* and 1*h*.

A monolithic catalyst converter of the Third Preferred Embodiment is thus manufactured. In this monolithic catalyst converter, the holding members 3 and 4 thermally expand greater than the catalyst container 1 does, and clamp the indentations 1*g* and 1*h* of the tube-shaped member 1*c* between themselves and the sealing member 5. Therefore, the monolithic catalyst 2 can be held firmly in the catalyst container 1. Further, in the monolithic catalyst converter, the sealing member 5 expands and solidifies between the indentations 1*g* and 1*h* where the tube-shaped member 1*c* is reduced diametrically, and accordingly exhibits a large resilient force. Hence, the monolithic catalyst converter can effect not only high rigidity for holding the monolithic catalyst 2, but also high air-tightness. Furthermore, in the monolithic catalyst converter, the holding member 3 or 4 is disposed on the exhaust-gas-inlet side of the monolithic catalyst converter, and can inhibit the exhaust gases of elevated temperatures from degrading the sealing member 5.

In addition to these extra advantages, the monolithic catalyst converter can apparently produce the advantages effected by the First and Second Preferred Embodiments.

Having now fully described the present invention, it will be apparent to one of ordinary skill in the art that many changes and modifications can be made thereto without departing from the spirit or scope of the present invention as set forth herein including the appended claims.

What is claimed is:

1. A process for manufacturing a monolithic catalyst converter, comprising the steps of:

fitting a monolithic catalyst into a tube-shaped workpiece having opposite opening ends through one of the opposite opening ends; and drawing the tube-shaped workpiece at the opposite opening ends into a funnel shape by means of spinning, thereby completing a monolithic catalyst converter without carrying out welding.

2. The process according to claim 1 wherein, in said tube-shaped-workpiece-drawing step after said monolithic-catalyst-fitting step, the tube-shaped workpiece is continuously drawn at the opposite opening ends into a funnel shape.

3. The process according to claim 1 further including, before said monolithic-catalyst-fitting step, disposing a sealing member on a middle peripheral surface of the monolithic catalyst, and a ring-shaped holding member apart from the sealing member on either one of the opposite-end sides of the sealing member; and after said tube-shaped-workpiece-drawing step, crimping the tube-shaped member at a portion which is positioned between the sealing member and the ring-shaped holding member.

4. The process according to claim 3, wherein, in said disposing step, a pair of the ring-shaped holding members are disposed apart from the sealing member on both of the opposite-end sides of the sealing member; and in said crimping step, the tube-shaped member is crimped at portions which are positioned respectively between the sealing member and one of the ring-shaped holding members, and between the sealing member and another one of the ring-shaped members.

5. The process according to claim 3, wherein said crimping step is carried out by means of rolling.

6. The process according to claim 1, wherein, before said tube-shaped-workpiece-drawing step, the tube-shaped workpiece is thermally treated locally at the opposite end openings.

7. The process according to claim 1, wherein, in said tube-shaped-workpiece-drawing step, the tube-shaped workpiece is thermally treated locally at the opposite end openings.

8. The process according to claim 1, wherein, in said tube-shaped-workpiece-drawing step, the tube-shaped member is held and rotated by a chuck and is drawn to the funnel-shaped cone members at the opposite ends by a roller disposed rotatably.

9. A process for manufacturing a monolithic catalyst converter, comprising the steps of:

drawing a tube-shaped workpiece having opposite opening ends at one of the opposite openings ends into a funnel shape by means of spinning;

fitting a monolithic catalyst into the tube-shaped workpiece through another one of the opposite opening ends; and drawing the tube-shaped workpiece at said another one of the opposite opening ends into a funnel shape by means of spinning, thereby completing a monolithic catalyst converter without carrying out welding.

10. The process according to claim 9, wherein, in each said tube-shaped-workpiece-drawing step, the tube-shaped member is held and rotated by a chuck and is drawn to the funnel-shaped cone members at one of the opposite ends by a roller disposed rotatably.

11. The process according to claim 9, further including, before said monolithic-catalyst-fitting step, disposing a sealing member on a middle peripheral surface of the monolithic catalyst, and a ring-shaped holding member apart form the sealing member on either one of the opposite-end sides of the sealing member; and after said second tube-shaped-workpiece-drawing step, crimping the tube-shaped member at a portion which is positioned between the sealing member and the ring-shaped holding member.

12. The process according to claim 11, wherein, in said disposing step, a pair of the ring-shaped holding members are disposed apart from the sealing member on both of the opposite-end sides of the sealing member; and in said crimping step, the tube-shaped member is crimped at portions which are positioned respectively between the sealing member and one of the ring-shaped holding members, and between the sealing member and another one of the ring-shaped members.

13. The process according to claim 11, wherein said crimping step is carried out by means of rolling.

14. The process according to claim 9, wherein, before said first tube-shaped-workpiece-drawing step, the tube-shaped workpiece is thermally treated locally at the opposite end openings.

15. The process according to claim 9, wherein, in each said tube-shaped-workpiece-drawing step, the tube-shaped workpiece is thermally treated locally at the opposite end opening being drawn into a funnel shape.

* * * * *